United States Patent [19]

Scheel et al.

[11] 4,166,754

[45] Sep. 4, 1979

[54] PROCESS AND DEVICE FOR CLEANING CATHODE SURFACES

[75] Inventors: Wolfgang Scheel; Reiner Berns; Wolfgang Heinen, all of Rheinberg, Fed. Rep. of Germany

[73] Assignee: Deutsche Solvay-Werke GmbH, Solingen-Ohligs, Fed. Rep. of Germany

[21] Appl. No.: 760,850

[22] Filed: Jan. 21, 1977

[30] Foreign Application Priority Data

Jan. 21, 1976 [DE] Fed. Rep. of Germany ..... 2602084

[51] Int. Cl.[2] ..... B08B 3/02; B08B 9/00

[52] U.S. Cl. ..... 134/24; 134/167 R; 134/180; 239/187

[58] Field of Search ..... 134/152, 167 R, 167 C, 134/168 R, 168 C, 172–175, 180–181, 198, 24, 34, 42, 43; 239/186–187

[56] References Cited

U.S. PATENT DOCUMENTS

| | | | |
|---|---|---|---|
| 1,704,364 | 3/1929 | Markley | 134/168 C |
| 2,497,171 | 2/1950 | Jones et al. | 134/198 X |
| 3,444,869 | 5/1969 | Guignon et al. | 134/167 R |
| 3,620,233 | 11/1971 | Busse et al. | 134/167 R X |
| 3,780,747 | 12/1973 | Stadie et al. | 134/172 X |
| 3,998,388 | 12/1976 | Alagna | 134/172 X |

FOREIGN PATENT DOCUMENTS

| | | | |
|---|---|---|---|
| 1461447 | 12/1968 | Fed. Rep. of Germany | 134/172 |

*Primary Examiner*—Marc L. Caroff

*Attorney, Agent, or Firm*—Schwartz, Jeffery, Schwaab, Mack, Blumenthal & Koch

[57] ABSTRACT

Vertically oriented cathode grids or cathode plates, adjacently situated at closely spaced intervals in a cathode box, are cleaned by spraying jets of liquid onto the cathode surfaces at an angle of about 10°–50° and at a pressure of about 60 to 140 atmospheres, while moving the liquid jets uniformly along the cathode surfaces. A device for performing this process comprises a bar shaped spraying means comprising spraying nozzles which are connected to pressure resistent feeding means for the liquid. The spraying means is connected to a guiding system comprising a bar shaped first guiding means, a second guiding means including a guiding bar and a guiding cylinder and a third guiding means and moving means mounted on a support which can be moved over the cathode box and which further comprises means for aligning the guiding system and the spraying means to the cathode box in such a way that the spraying means can be moved uniformly along the cathode surfaces by means of the guiding means and the moving means.

38 Claims, 8 Drawing Figures

12
16
11
15
18
5
17
6
6
9
4
4
8
4
1
7
2
3
3
10
10

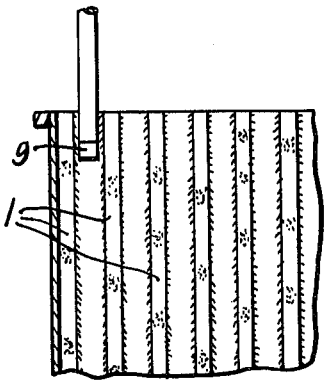
Fig. 2.
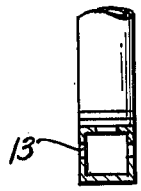
Fig. 4A.
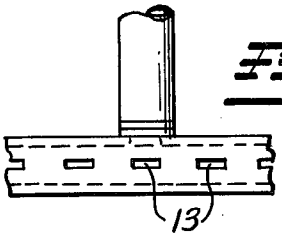
Fig. 4B.
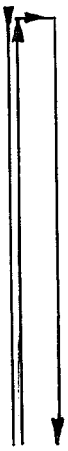
Fig. 3.
Fig. 4C.
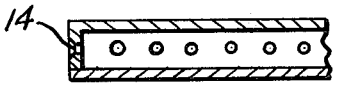
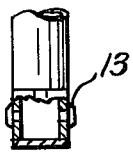
Fig. 4D.
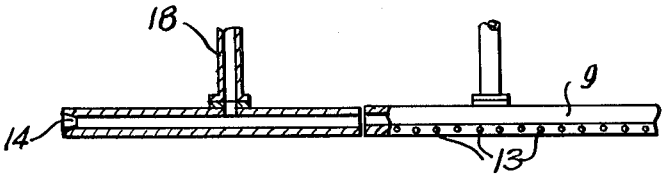
Fig. 4.

PROCESS AND DEVICE FOR CLEANING CATHODE SURFACES

BACKGROUND OF THE INVENTION

The present invention relates to the cleaning of cathode surfaces such as cathode grids and/or cathode plates by means of suitable liquids.

According to conventional methods, electrodes, e.g., cathode grids are sprayed with a water jet in order to remove impurities and/or the contaminated diaphragm layers. Since the sprayer is operated by a person who usually is forced to work in the open air and/or to apply certain protective measures and/or devices because of the resulting splashing, dirt, and the like, and since by this person the water jet which is ejected from the sprayer can only be directed to a certain part of the cathode grid at a time from a certain distance, these cleaning methods are very time consuming and are not very effective, especially in the case of cathode grids which are coated with a diaphragm layer (e.g., asbestos fibers). Often the cathode grids which are treated in such a way are still not completely clean. Therefore a thorough cleaning is only possible by investing a considerable amount of work, time and money.

Furthermore, the cathode boxes which contain the cathode grids or cathode plates are difficult to handle because of their weight and their size. The cathode boxes usually contain several cathode grids or cathode plates which are arranged to about equal distances from each other, and two cathode grids or cathode plates, which are arranged next to each other and about parallel to each other are called a cathode pocket. The distance between the cathode grids varies according to the construction of the assembly. In several embodiments, distances are between 30 and 60 mm. The height of the cathode grids and the length and breadth of the cathode box vary as well.

Because of the relatively small distance between the cathode grids, these grids are also difficult to clean mechanically, and manual cleaning is very difficult and can be performed only incompletely.

Yet, in the case of cathode grids which are covered, e.g., with a layer of asbestos fibers for diaphragm electrolysis, these layers must also be removed or washed off from the grids together with the impurities. On the other hand, the removing and cleaning operation for removing the deposited impurities or the contaminated diaphragm layers, preferably the contaminated layers of asbestos fibers, should be effected as quickly as possible since the liquids, impurities and the like which adhere to the cathode grids may be corrosive and especially under the access of air the cathode grids may corrode quickly. Furthermore, after a certain period of time the contaminated asbestos clings so strongly to the cathode grids that cleaning these grids with water is hardly possible anymore.

SUMMARY OF THE INVENTION

It is an object of the present invention to provide a process for cleaning cathode surfaces such as, e.g., cathode grids or plates, which permits fast and efficient removal of impurities and/or of contaminated diaphragm layers, preferably asbestos layers or asbestos containing layers from cathode surfaces such as cathode grids or cathode plates.

It is a further object of the present invention to provide for such a process which allows reduction of the amount of liquid, e.g., water or other liquids or solvents, which are suitable for removing the impurities and/or contaminated diaphragm layers which is needed for the cleaning operation.

It is a further object of the present invention to provide such a process which permits reduction of the cleaning time and thereby attributes to avoiding corrosion of the cathode grids.

It is a further object of the present invention to provide such a process which avoids the vary difficult manual work and other inconveniences connected therewith during the cleaning operation.

It is a further object of the present invention to provide such a process which permits a controlled, preferably automatically controlled uniform cleaning of the cathode surfaces.

It is a special object of the present invention to provide such a process which permits fast and efficient cleaning of cathode grids which are used in a diaphragm process, especially cathode grids which are covered with asbestos material.

It is a further object of the present invention to provide such a process which permits fast and efficient cleaning of cathode grids which are arranged in a cathode box, preferably substantially parallel to each other.

It is a further object of the present invention to provide such a process which allows a fast and efficient cleaning of cathode surfaces which are particularly endangered by corrosion due to the type of impurities and liquids which adhere to them, especially cathode grids which are used within the diaphragm process of chlorine alkali electrolysis.

It is a further object of the present invention to provide a device for performing such a process of cleaning cathode surfaces.

It is a further object of the present invention to provide a device which provides means for thorough and uniform cleaning of cathode surfaces and for complete washing off of soil deposits and/or contaminated diaphragm layers, e.g., layers of asbestos fibers, from such surfaces.

It is a further object of the present invention to provide a device which provides means for cleaning surfaces of cathodes which are arranged substantially parallel to each other and at relatively small distances from each other within a cathode box.

It is a further object of the present invention to provide a device which provides means for a controlled, preferably an automatically controlled cleaning operation.

It is a further object to provide such a device which also provides for the possibility of manual operation, in case of any disturbances or irregularities.

It is a further object to provide a device which permits a fast and thorough cleaning of cathode surfaces, especially of cathodes which are arranged within a cathode box, without damaging the cathodes.

In order to accomplish the foregoing objects, according to the present invention there is provided a process for cleaning cathode surfaces such as cathode grids and/or cathode plates by treatment with a liquid, such as water and/or other liquids which are suitable for this cleaning purpose, which comprises the steps of spraying at least one jet of at least one liquid, which is suitable for removing or dissolving soil deposits and layers of material which are adherent to and deposited on the cathode surfaces, against at least one cathode surface which is to be cleaned from at least one orifice of a spraying means at a pressure of from about 60 to about 140, preferably from about 110 to about 130 atmospheres (determined as outlet pressure at the orifice of the spraying means), and at an angle of about 10° to about 50°, preferably of about 25° to about 35°, relative to the cathode surface which is to be cleaned. The process is especially suited for cleaning a set of cathodes which are arranged in a row at about equal distances to each other. The liquid which is used within this process may be water and/or another liquid or solvent which is capable of dissolving, washing off and/or removing soil deposits and/or layers of materials which are adherent to or deposited on the cathode grids and/or cathode plates. The liquid is preferably sprayed out of an orifice of a spraying means such as a nozzle, preferably a flat section jet nozzle. The impurities and/or the contaminated diaphragm layers can easily be removed when the above-mentioned ranges of outlet angles are used. Thus, when several jets of water and/or liquid or solvent at about equal distances from each other are used, they each act on a certain portion of the cathode grid and/or a certain portion of the cathode plate, and preferably are moved along the surface continuously with a speed as uniform as possible in order to effect a cleaning as uniform as possible and to shorten the cleaning operation by a controlled treatment of the surface.

According to the present invention there is further provided a device for cleaning cathode surfaces, such as cathode grids and/or cathode plates by treatment with a liquid according to the above-described process, which device comprises at least one bar-shaped spraying means which comprises at least one spraying nozzle and to which is connected at least one pressure resistant feeding means for a liquid such as water and/or a cleaning liquid or solvent. Preferably, the nozzles which preferably are flat section nozzles are placed within or onto the bar-shaped spraying means at about equal distances from each other in a row or in rows arranged one above the other. In addition to these nozzles which are placed on the long sides of the bar-shaped spraying means, there may be cone-shaped jet or hollow cone-shaped jet nozzles placed on the broad side of the spraying means. The spraying means preferably is connected to at least one bar-shaped guiding means. In order to effect the movements, especially the upward and downward movements, the spraying means is preferably connected to at least one second guiding means through the intermediary of at least one of said first guiding means. The second guiding means comprises at least one guiding bar and at least one guiding cylinder which are movably connected to each other, whereby preferably the guiding bar is placed movably within the guiding cylinder. Preferably, at least one of the parts of the second guiding means is movably connected to and preferably placed within a third moving means. This third moving means preferably is itself movably connected to a basic support through intermediary sliding means.

In order to insure a sufficient pressure of the ejected liquids according to the invention, the orifices of the nozzles of the spraying means have a diameter of about 1.2–2.5 mm, preferably about 1.5–2.0 mm. The throughput of the nozzles is from about 5 to 25, perferably from about 10 to 20, liters per minute.

Further objects, features and advantages of the present invention will become apparent from the detailed description of the invention and its preferred embodiments which follows, when considered together with the accompanying figures of drawing.

BRIEF DESCRIPTION OF THE DRAWINGS

FIG. 2 is a cross-section of a cathode box;

FIG. 3 is a schematic diagram of the movement of the spraying means according to the invention; and FIG. 4 is an isolated view, partly in section, illustrating a two-part spraying means according to the invention.

FIGS. 4A, 4B, and 4D are isolated views, partly in section, showing relative positions of flat section jet nozzles on the two-part spraying means.

FIG. 4C is an isolated view, partly in section, showing the relative position of a hollow cone-shaped jet nozzle on the two-part spraying means.

DETAILED DESCRIPTION

Figure 1:
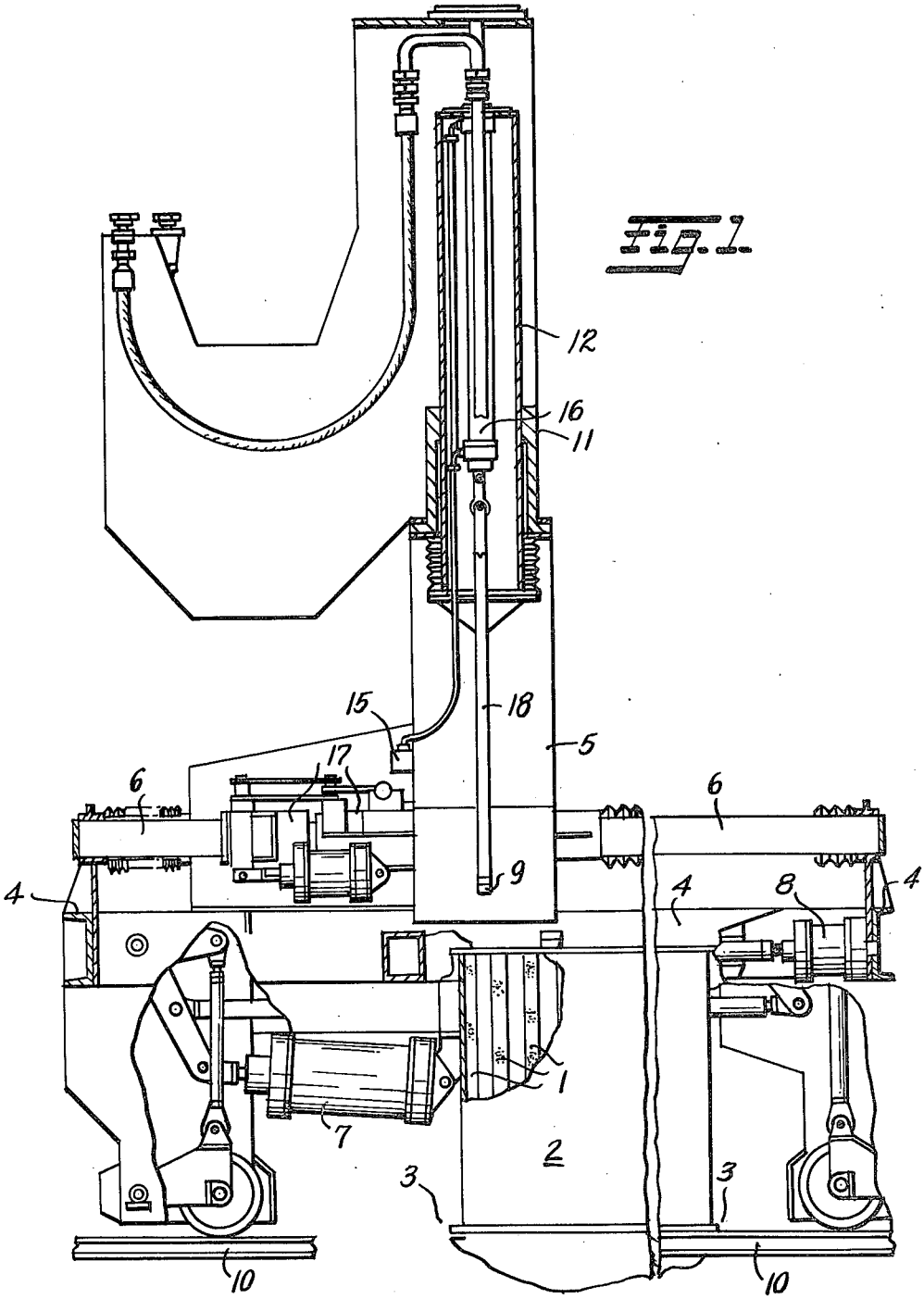
FIG. 1 is a plan view, partly in section, showing a device for cleaning cathode surfaces such as cathode grids or cathode plates according to the invention.

The liquid, e.g., the water and/or other cleaning liquid or solvent, is sprayed onto the cathode grids or cathode plates according to the process of this invention preferably in the form of a flat jet, most preferably as a fan-like shaped flat jet. It is advisable that there is a certain overlapping of the nozzle jets at the place where the liquid, e.g, the water or solvent strikes the cathode grid or cathode plate in order to avoid any remaining intermediate, uncleaned portions of the surface. It is preferred that the flat jets are directed parallel and/or plane-parallel toward the cathode grid or the cathode plate which is to be cleaned.

Within numerous tests it has been determined that advisably the angle of divergence of a fan-shaped or fan-like shaped flat jet is about 110° to about 40° preferably about 100° to about 80° and/or about 80° to about 50° in order that a sufficient cleaning effect is still ensured (even when using a very obtuse or a very acute angle).

The cleaning effect is especially strong if the fan-shaped or fan-like flat jets run parallel or plane-parallel to each other. In order to keep the bar shaped spraying means comprising the nozzles largely in balance with respect to the jet reaction forces which are caused by the ejecting jets of liquids or solvent, it is especially advisable that at least one pair of fan-shaped or fan-like shaped jets runs symmetrically or mirror symmetrically relative to the bar shaped spraying means.

According to an advantageous embodiment of the invention part of the edges or sidewalls of the cathode grids and/or cathode plates are additionally cleaned with a liquid and/or a solvent which is sprayed onto them in the form of a cone-shaped or hollow cone shaped jet. In this way, the impurities and layers on this part of the edges or side walls are removed. The throughput of the flat jet nozzles and/or cone-shaped jet or hollow cone-shaped jet nozzles is between about 5 to about 25 liters/minute per nozzle, preferably between about 10 to about 20 liters/minute per nozzle.

According to a preferred embodiment of the invention, the bar-shaped spraying means is guided by a guiding means in such a way that a vertical movement (upward and downward) and subsequently a horizontal movement are effected without changing the alignment of the spraying unit relative to the cathode grids and/or cathode plates which are to be cleaned. In this way, a controlled and/or automatically controlled process can be achieved.

Within the meaning of this process a liquid or a solvent is a liquid suitable for cleaning and dissolving and/or removing the impurities, asbestos fibers and the like, there are used such liquids which do not attack or do not appreciably attack the cathode grids or cathode plates. The liquids do not have to dissolve the impurities in the sense of forming a chemical solution, but should simply remove them from the cathode surface. Preferably, water is used. Yet industrial effluents or other suitable liquids may also be applied as far as they do not attack the cathode plates or soil the nozzles in the spraying means. Depending on the liquids or the impurities which adhere to the cathode plate or the cathode grids, sometimes a pretreatment for neutralisation can be performed or low amounts of neutralizing agents in the form of appropriate additives may be added to the water or other liquid. In the same way it is possible to add a corrosion inhibiting agent for certain purposes. Yet the use of such preliminary treatment or additives can be generally omitted or avoided by using the process and the device according to this invention.

In order to ensure a sufficient pressure of the ejected liquids according to the invention, the orifices of the flat jet section nozzles and/or the cone-shaped or hollow cone-shaped jet nozzles of the spraying means of the device according to this invention have a diameter of about 1.2 to about 2.2 mm, preferably of about 1.5 to about 2.0 mm. The throughput of the nozzles, e.g., the flat jet nozzles and/or the cone-shaped or hollow cone shaped jet nozzles, is from about 5 to about 25 liters/minute, preferably from about 10 to about 20 liters/minute per nozzle.

According to an especially preferred embodiment of the device according to the invention, at least one of the pressure resistant feeding means which are connected to the spraying means are shaped as to serve as at least one first bar-shaped guiding means, and/or at least one pressure-resistant feeding means is surrounded by a guiding tube or attached to a guiding rod which serves as a support for the feeding means. Preferably, the first bar-shaped guiding means is firmly connected to the bar-shaped spraying means and to the guiding bar of the second guiding means.

According to an especially advantageous embodiment, the flat jet nozzles and/or the cone-shaped jet or hollow cone-shaped jet nozzles are arranged symmetrically on the bar-shaped spraying means and/or symmetrically relative to the axis of rotation of the guiding bar or the guiding cylinder. Thereby a second cathode plate or an uncoated or coated cathode grid (e.g., coated with a diaphragm layer of asbestos fibers) which is placed on the opposite side can be cleaned as well during the upward and downward movement, and the second guiding means which is the guiding bar and the guiding cylinder can be balanced against the resulting reaction forces. Within this embodiment, it is advantageous to use only a guiding bar which is movable within a guiding cylinder and which is axially connected to the bar-shaped spraying means.

The cone-shaped or hollow cone-shaped jet nozzles for cleaning a portion of the edges or side walls of the cathode grids or cathode plates which are situated at the end or close to the end of the bar-shaped spraying means preferably are arranged symmetrically on the spraying means and/or symmetrically relative to the axis of rotation of the guiding cylinder or guiding bar.

At least one of the parts of the second guiding means, e.g., the guiding cylinder or the guiding bar, is placed movably preferably movably in the vertical direction within a third guiding means. According to a preferred embodiment, the guiding bar is connected with a moving means which preferably is a driving cylinder. In this way, it is possible that movement of the guiding bar can be effected by means of pneumatic or hydraulic pressure drives within this advantageous embodiment. According to other embodiments of the invention, this movement can also be effected electrically or mechanically.

Thus, the moving means which causes the movement preferably in the vertical direction of the bar-shaped spraying means is connected directly or indirectly with the guiding bar. Thereby the movement of the bar-shaped spraying means along each of the cathode grids (upward and downward movement) is effected by means of electrical or pneumatic or hydraulic pressure drive, and an automatically controlled operation is made possible.

The third guiding means itself is movably connected to a guide way, such as a guide bar, a guide rail or the like, for restricted guidance. In order to achieve restricted guidance, the third guiding means is movably connected to the guideway by means of at least one sliding means such as a sliding carriage or similar sliding means.

Thus, the third guiding means is placed on at least one sliding carriage or similar sliding means in such a manner that it is movable along the guide bar, guide rail or similar guide way, preferably in the horizontal or nearly horizontal direction.

The guide way, such as guide rails, guide bars or the like, are arranged on a support (basic support) which is movable, preferably on guide rails by means of rolling means such as wheels rolls or wheel-like or roll-like means. Thus, this support (basic support) is a movable support which in addition to guide ways and rolling means may further comprise carrying means, spacing means, connecting rods, connecting cross pieces and the like. If necessary the wheels or rolls may be replaced by a chain in combination with a chain driver.

According to an advantageous embodiment the wheels or rolls of the support (basic support) are connected to the support by means of draw- and/or lever bars (which optionally are guided about an axle) in such a way that they can be fixed at different heights, and the support may be pneumatically lowered down from a higher position onto the cathode box containing a set of cathodes.

According to an embodiment of the invention, the bar-shaped spraying means may also be movable in the horizontal or nearly horizontal direction, whereas the sliding carriage within this embodiment is movable in the vertical direction.

According to a preferred embodiment of the invention, the bar-shaped spraying means comprises at least two parts which are connected to each other in a conventional manner, e.g., by means of bolted joints, screws, connecting pieces and the like. When the bar-shaped spraying means comprises at least two parts and when each part is connected to separate feeding means for the water or the liquid, the build up of the necessary pressure can be achieved faster.

In special situations (e.g., partial failure of the water supply) the cleaning process can nevertheless be performed with the still-functioning part of the spraying means.

According to an especially preferred embodiment the bar-shaped spraying means is guided by the guiding system comprising the three guiding means in such a way that a vertical or nearly vertical movement (upward and downward movement) is followed by a horizontal or nearly horizontal movement, without changing the alignment of the bar-shaped spraying means relative to the cathode grids and/or cathode plates and without any particular change in the angle of the subsequent movements.

The spraying means is connected to the third guiding means through the intermediary of the first bar-shaped guiding means and the second guiding means, the guiding bar and the guiding cylinder, and by means of a pneumatic cylinder which is coupled with oil hydraulic conversion to the driving cylinder by means of a throttle valve. In this manner, it is possible for the movement, preferably the downward movement, to be performed with uniform or nearly uniform speed.

The support (basic support), which is movable by using rolling means, such as, rollers, wheels or wheel-like or roll-like means, comprises pneumatic or hydraulic pressure cylinders which align the guiding system comprising the three guiding means, which is mounted on the support, and therefore also the bar-shaped spraying means relative to the cathode grids and/or cathode plates which have to be cleaned. The pressure cylinder preferably are dimensioned so as not to deform or damage the cathode box.

Additionally at least one stepwise switching means or a similar means is connected to the sliding means, e.g. the sliding carriage or similar sliding means and/or to the support (basic support) and/or to the guiding means, by means of which a backward and forward movement at a certain interval can be produced.

The process and the device according to the present invention are especially suited for fast and uniform cleaning of cathode grids and/or cathode plates. The process and the device are preferably used for cleaning cathode grids, which are applied within a diaphragm process. For this purpose, the cathode grids are coated with appropriate materials according to their use, e.g., asbestos fibers. The cathode plates or cathode grids are preferably arranged within the above mentioned cathode box parallel or nearly parallel to each other.

Special advantages can be achieved by using the process and the device according to this invention for cleaning cathode grids which were soiled within a diaphragm process of chlorine-alkali electrolysis. Cathode grids which have been used in a chlorine-alkali electrolysis are especially endangered by corrosion, because the adhering liquid can attack the wire grid; therefore a fast and thorough cleaning and removal of the impurities are necessary. By means of the process and the device according to the present invention, the soiled asbestos fiber diaphragm layers, which have been used in chlorine-alkali electrolysis, can also be removed or separated from the cathode grid together with the impurities in a relatively short period of time.

Referring now to the drawings, according to their invention cleaning of a cathode box, which contains cathode grids or cathode plates (1) can be effected as follows: the cathode box (2) is transported to the cleaning device, e.g., by means of a fork-lift and there it is placed down on a locking means (3) preferably at least one locking bolt. The support (basic support) (4), onto which the third guiding means (5) is mounted movably along the guide ways (6), e.g., guide rails, guide bar or the like, by means of at least one corresponding sliding means, e.g., a sliding carriage or a similar sliding means or rail like means, is pushed over the cathode box into a position slightly above the cathode box, preferably by means of rolling means, e.g., rollers, wheels and the like, and then is lowered onto the cathode box by means of the pneumatical drive (7) for adjusting the height at which the wheels are placed. The support is aligned relative to the cathode box using the hydraulic or pneumatic pressure cylinders (8). Thereby a more exact parallel guiding of the bar-shaped spraying means (9) parallel or nearly parallel to the cathode grids or the cathode plates (1) is achieved and damaging of the wire grids is avoided. Therefore, the locking means (3) should also be calibrated or be calibratable.

In order to provide for continuous working it is particularly advisable to arrange at least one other locking means or locking bolt (3) for holding a further soiled cathode box (2) adjacent to the first locking means so that after finishing the cleaning operation on the first cathode box the support (4) may be transported to the next cathode box, e.g., along guide rails (10) by means of rollers, wheels or the like.

The lower end of the guiding bar (12) which is movably placed within the guiding cylinder (11) is connected to the bar-shaped spraying means (9) by means of at least one first bar-shaped guiding means (18). The bar-shaped spraying means (9) comprises the flat section jet nozzles (13) and the cone-shaped or hollow cone-shaped jet nozzles (14) at the edge or end portions and is run electrically, pneumatically or preferably hydraulically by turning on the moving means (16) for the vertical movement (driving cylinder). The bar-shaped spraying means (9) in connection with the guiding bar (12) moves with a certain feed speed which is controlled, preferably hydraulically, during the downward movement. The bar-shaped spraying means is connected to a pneumatic cylinder by means of at least one first bar-shaped guiding means or the guiding cylinder or the guiding bar and the pneumatic cylinder is coupled to the driving cylinder (16) with oil hydraulic conversion by means of a throttle valve (15). Therefore, an almost uniform speed can be maintained during the downward movement of the spraying means. According to a preferred embodiment, the moving speed of the bar-shaped spraying means or the guiding bar is adjusted so that the spraying means moves at a higher speed during the upward movement than during the downward movement, especially if during the downward movement the cleaning and the removal of soil impurities, asbestos fibers and the like is effected, whereas during the upward movement the cleaning operation is practically finished.

By means of a stepwise switching means or a similar means the forward or backward movement of the sliding carriage or similar sliding means, which carries the third guiding means, is effected through a starting means subsequent to an upward movement (or if the cleaning is effected starting from below, subsequent to a downward movement).

The sliding carriage or similar sliding means and thereby the third guiding means (5) is driven pneumatically for the forward or backward movement. Each forward or backward movement is adjusted to and ensured at a distance corresponding to about the distance between the centers of two adjacent pockets formed between the cathodes within the set by means of appropriate holes or recesses or the like or optionally protrusions on the guide rail (6).

A preferred embodiment of the invention is shown in the drawings (FIGS. 1 to 4).

FIG. 1 shows the device for cleaning the cathode grids or cathode plates. FIG. 2 shows a cross-section of the cathode box containing the cathode grids or cathode plates (1), the surfaces of which are soiled. Between the cathode grids, the spraying means (9) is moving downwardly and upwardly during the cleaning operation. FIG. 3 shows a diagram of the movement of the spraying means (9) which is guided in such a way that subsequent to a vertical movement downward and upward movement of the spraying means between two cathode grids, a horizontal movement—above the cathode grids—takes place. Thereby, the edge of the cathode grid is cleaned as well. FIG. 4 shows a two-part spraying means (9). Both parts are connected to each other, e.g., by a threaded connection. This spraying means comprises flat section jet nozzles (13) as well as cone-shaped jet or hollow cone-shaped jet nozzles (14) at its edge portions. Reference numeral 18 designates the bar-shaped first guiding means.

The device according to FIG. 1 is driven over a cathode box (2). The latter is ensured against sliding by means of a locking means (3). The device according to this embodiment of the invention comprises a support (4) or a basic support which can be moved over the cathode box (2) along the guide rails (10) by means of rollers or wheels. The third guiding means (5) and hence the bar-shaped spraying means (9) is arranged movably in the horizontal direction along the guide rails or guide bar (6) of the support (4). The support (4) is lowered down onto the cathode box (2) by means of a pneumatic drive (7) by which the height of the rollers or wheels can be adjusted on this support. Thereby the pressure cylinders (8) align the support (4) relative to the cathode box (2). In this way, the bar-shaped spraying means (9) is aligned parallel or nearly parallel to the cathode grid, particularly to the middle of the pockets between the cathodes, and damaging of either side is avoided. The bar-shaped spraying means (9) which is connected to the guiding bar (12) through the intermediary of the bar-shaped first guiding means (18) is guided by means of the guiding cylinder (11) and is run by a moving means (16) (driving cylinder). The uniformity of the downward movement of the bar-shaped spraying means within the space between the cathode grids is ensured by the fact that the bar-shaped spraying means (9) is connected (by means of the guiding bar (12) and the guiding cylinder (11) or the third guiding means (5)) to a pneumatic cylinder which in turn is coupled to the moving means (16), i.e., the driving cylinder, with oil hydraulic conversion by means of a throttle valve (15). Reference numeral (17) designated the driving means for the third guiding means (5), and thus, indirectly also for the spraying unit (9). This driving means is connected to the sliding carriage or the bar (6) and is provided with a stepwise controlling means. By means of this arrangement, a forward or backward movement of the spraying means can be adjusted to a certain distance, especially to a distance corresponding to the distance between the center of two adjacent pockets formed between the cathodes.

What is claimed is:

1. A device for cleaning the surfaces of vertically oriented, adjacently situated cathodes fixed at closely spaced intervals in a cathode box, comprising:

(a) at least one horizontally oriented elongated support member;

(b) a plurality of first spraying nozzles supported by said support member for spraying a liquid under pressure against said cathode surfaces, said spraying nozzles being spaced at approximately equal distances from one another in at least one row axially along said support member and being oriented so as to spray the liquid at an angle of from about 10° to 50° with respect to the vertical surfaces of said cathodes;

(c) at least one nozzle means comprising second spraying nozzles on end portions of said support member for spraying said liquid under pressure against the edge and/or border portions of said cathodes, each of said second spraying nozzles comprising a conical cross-section jet nozzle;

(d) means for moving said support member and nozzles vertically into and out of the space formed between said adjacent cathodes, said moving means comprising at least one vertically oriented guiding bar rigidly attached to said support member, a vertically oriented piston/cylinder means connected with the guiding bar, and transporting means attached to said piston/cylinder means adapted for transporting said piston/cylinder means along a railmember;

(e) pressure resistant means supported by said support member and said guiding bar and operatively connected to each of said spraying nozzles for feeding said liquid thereto at a pressure of from about 60 to 140 atmospheres;

(f) a base which includes at least one horizontally oriented said rail member operatively connected to said transporting means;

(g) rolling means connected with the underside of said base for transporting said device; and (h) means connected with said base and said rolling means for vertically adjusting the orientation of said base with respect to said rolling means, whereby said device can be oriented vertically with respect to the cathodes.

2. A process for cleaning the surfaces of vertically oriented, adjacently situated cathodes fixed at closely spaced intervals in a cathode box, comprising the steps of:

(a) driving the device as defined in claim 1 over said cathode box so that the cathode box is positioned underneath the base of the device (b) introducing the support member of said device into one of the intervals;

(c) spraying through the spraying nozzles, supported by said support member, at least one stream of liquid at a pressure of from about 60 to 140 atmospheres against said surface of the cathode at an angle of from about 10° to 50° with said cathode surface; and (d) removing said support member from said interval.

3. The process as defined by claim 2, wherein said liquid comprises water as at least a major portion thereof.

4. The process as defined by claim 2, wherein said cathode surfaces comprise cathode grids.

5. The process as defined by claim 2, wherein said cathode surfaces comprise cathode plates.

6. The process as defined by claim 2, wherein the angle between the liquid stream and the cathode surface is from about 25° to 35°.

7. The process as defined by claim 2, wherein the pressure of the liquid is from about 110 to 130 atmospheres.

8. The process as defined by claim 2, wherein at least one of the first spraying nozzles is a flat section jet nozzle.

9. The process as defined by claim 2, wherein a plurality of liquid streams are sprayed against the cathode surface.

10. The process as defined by claim 2, further comprising continuously moving said stream of liquid over the cathode surface.

11. The process as defined by claim 9, wherein the streams of liquid are at about equal distances from each other.

12. The process as defined by claim 2, wherein the liquid is sprayed in the form of at least one flat stream.

13. The process as defined by claim 12, wherein the flat stream comprises an approximately fan-shaped configuration.

14. The process as defined by claim 13, wherein the angle of divergence of the fan-shape is from about 40° to about 110°.

15. The process as defined by claim 14, wherein the angle of divergence of at least part of the fan-shaped streams is from about 80° to about 100°.

16. The process as defined by claim 14, wherein the angle of divergence of at least part of the fan-shaped streams is from about 50° to about 80°.

17. The process as defined by claim 13, wherein the streams are parallel.

18. The process as defined by claim 13, wherein the streams are plane-parallel.

19. The process as defined by claim 10, wherein the plurality of streams are symmetrically arranged.

20. The process as defined by claim 10, wherein the plurality of streams are arranged mirror symmetrically.

21. The process as defined by claim 2, further comprising spraying the liquid onto the edges and sidewalls of the cathode surfaces in the form of at least one cone-shaped stream.

22. The process as defined by claim 2, wherein the flow-rate of each stream is from about 5 to about 25 liters/minute.

23. The process as defined by claim 22, wherein the flow-rate of each stream is from about 10 to about 20 liters/minute.

24. The process as defined by claim 2, wherein the streams are first moved vertically and subsequently horizontally without changing the alignment of the streams relative to the cathode surface.

25. The device as defined by claim 1, wherein said first spraying nozzles comprise flat cross-section jet nozzles.

26. The device as defined by claim 1, wherein said first spraying nozzles are attached to said support member.

27. The device as defined by claim 1, wherein said first spraying nozzles are contained within said support member.

28. The device as defined by claim 1, wherein at least one of said guiding bars comprise said liquid feeding means.

29. The device as defined by claim 27, wherein said piston/cylinder means connected with said guiding bar is fluid actuated.

30. The device as defined by claim 1, wherein said spraying nozzles are arranged symmetrically about said support member.

31. The device as defined by claim 29, wherein said spraying nozzles are arranged rotationally symmetrically with respect to said piston/cylinder means.

32. The device as defined by claim 1, wherein each of said spraying nozzles comprises a nozzle opening having a diameter of from about 1.2 to 2.5 mm.

33. The device as defined by claim 32, wherein said opening has a diameter of from about 1.5 to 2.0 mm.

34. The device as defined by claim 1 wherein said transporting means includes means for sliding along said railmember.

35. The device as defined by claim 29, wherein said moving means further comprises means for automatically driving said piston portion of said piston/cylinder means in a vertical direction.

36. The device as defined by claim 35, wherein said piston/cylinder means comprises an oil hydraulic pneumatic cylinder and said automatic driving means comprises a throttle valve connected in the oil hydraulic cylinder circuit.

37. The device as defined by claim 1, wherein said vertically adjusting means comprise a fluid actuated cylinder.

38. The device as defined by claim 1, wherein said transporting means further comprises means connected therewith for stepwise advancing said transporting means a predetermined distance along said rail member(s).

* * * * *